United States Patent [19]

Kuklinski

[11] 4,142,379

[45] Mar. 6, 1979

[54] WASTE ENERGY RECOVERY SYSTEM

[76] Inventor: Henry W. Kuklinski, 6222 SW. 2nd Ct., Plantation, Fla. 33314

[21] Appl. No.: 714,630

[22] Filed: Aug. 16, 1976

[51] Int. Cl.[2] ..... F25B 1/00

[52] U.S. Cl. ..... 62/179; 62/238

[58] Field of Search ..... 62/238, 79, 159, 129, 62/179, 183; 237/2 B; 219/279

[56] References Cited

U.S. PATENT DOCUMENTS

| | | | |
|---|---|---|---|
| 1,148,865 | 8/1915 | Shipman | 165/156 |
| 1,854,402 | 4/1932 | Goosmann | 62/129 X |
| 2,102,940 | 12/1937 | Buchanan | 62/238 X |
| 2,551,758 | 5/1951 | Newton | 62/184 X |
| 2,952,991 | 9/1960 | Pierre | 62/184 |
| 3,739,594 | 6/1973 | Freese | 62/238 X |
| 3,922,876 | 12/1975 | Wetherington, Jr. et al. | 62/238 |

*Primary Examiner*—William E. Wayner
*Attorney, Agent, or Firm*—Malin and Haley

[57] ABSTRACT

An energy saving device that utilizes the rejected heat from an air conditioning unit for heating water or other suitable liquid in a conventional liquid heating storage tank. The primary heater control in the storage tank is turned off whenever the air conditioning compressor is operating by a pressure sensing switch in the compressor line that is wired in series with the tank heater control circuit. A water circulating pump is used to pass relatively cold tank water through a heat exchanger which is connected to the compressor outlet conduit of the air conditioner. The pump is controlled by a thermostatic switch which measures heat exchanger outlet water temperature. The device not only utilizes otherwise rejected heat energy from an air conditioning unit for heating water in a conventional hot water tank but also increases the efficiency and endurance of the air conditioning system by removing super heat from the compressor gases.

3 Claims, 1 Drawing Figure

WASTE ENERGY RECOVERY SYSTEM

BACKGROUND OF THE INVENTION

Figure 1:
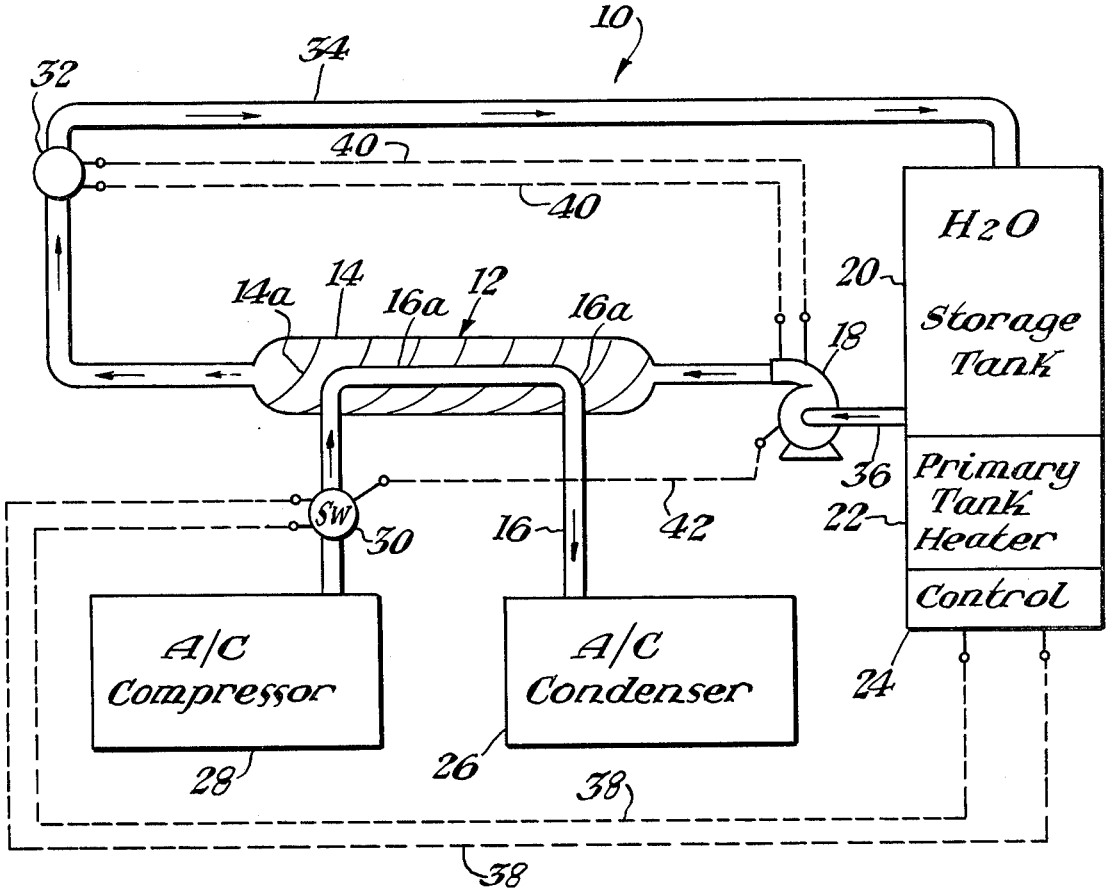

This invention relates generally to an energy saving device which is connected between a conventional water heater storage tank and the compressor outlet side of a conventional air conditioning unit, which utilizes the rejected heat from the air conditioning compressor in order to heat water in the storage tank.

In recent years increased energy demands and resultant increased fuel prices have made it necessary to seek increased efficiency in the operation of conventional energy consuming products.

Many homes, apartments, office buildings and the like today are equipped with air conditioning units which, due to the increased cost of electricity, have become more expensive to operate. These same buildings also have conventional storage tanks that heat and maintain a quantity of water at a predetermined temperature at all times. Devices are known in the prior art which act to conserve energy by utilizing the air conditioning exhaust heat energy for hot water heating. U.S. Pat. No. 3,922,876 for an energy conservation unit shows a water heating device which controls the circulating water through the heat exchanger by temperature control. No provision is made, however, to control the primary tank water heating source to insure maximum efficiency of the system. The instant invention overcomes deficiencies in the prior art by providing a compact unit that is readily attachable to a conventional water heater and air conditioning compressor unit, that provides for maximum heat transfer to the water heater whenever the air conditioner is operating and that completely turns off the primary heat source to the water storage tank when the air conditioning compressor is operating. The primary water tank heater can only be on when the air conditioning compressor is off and tank water temperature demands elevation.

The employment of the instant invention improves the coefficient of performance of the air conditioner resulting in additional savings in addition to the savings resulting from the heating of water with rejected air conditioning heat.

BRIEF DESCRIPTION OF THE INVENTION

A device for utilizing the rejected heat from an air conditioning compressor comprising a heat exchanger having a first chamber in fluid communication with a hot water storage tank, return conduits for allowing relatively cold water to flow from the tank through the first chamber of the heat exchanger and back to the tank, and a circulating pump thermostatically controlled in the water tank return line. The heat exchanger includes an inner conduit connected in fluid communication to the outlet of the compressor and a spiral baffle for directing liquid flow around the compressor gas containing pipe. Also connected to the compressor gas outlet line is a pressure sensing electrical switch which detects a pre-set compressor gas level, the switch being connected in series with the power control to the water storage tank heater. Whenever a pre-determined pressure level is achieved in a compressor line through the heat exchanger, (air conditioning compressor ON) the switch will be open, automatically turning off the primary heat source to the water storage tank. Whenever the air conditioning system is in operation and the compressor is on, the conventional heating source will be off. When the air conditioning system is not running (pressure below pre-set), the water heater functions in its conventional way whether gas, electric or oil powered heater.

The system is readily adaptable to conventional units already existing and can be quickly and easily installed, without affecting the normal operation of either the air conditioning unit or the water storage heater.

The unit may be assembled with all components mounted compactly within a rigid housing, with inlet and outlet conduit connectors disposed through the side walls of the housing. In one embodiment, mounted within the rigid housing is the heat exchanger which includes a conduit which receives the hot gasses from the air conditioning compressor and has inlet and outlet conduit coupling means attached to the housing side, a cold water line from the water storage tank which includes inlet and outlet coupling means for connecting the cold water line to the tank, a magnetic circulating pump coupled into the water line, a pressure sensing electrical switch connected to the compressor gas line and a thermostatically controlled switch measuring the outlet water temperature after it passes through the heat exchanger and which is electrically connected to the circulating pump.

The heat exchanger is made for increased efficiency in that the compressor hot gas conduit (which is constructed of a thermally conductive material such as copper) is positioned coaxially in the middle of the water chamger and is surrounded by spiral baffles that direct the water around the higher temperature compressor gases.

By removing the super heat from the compressor gases, the coefficient of efficiency of the air conditioner is increased, reducing operating costs and increasing system longevity.

It is an object of this invention to provide an improved energy conservation device which is adapted to be mounted between the compressor outlet conduit of an air conditioning unit and a conventional hot water heater for controlled water heating with rejected compressor heat.

It is another object of this invention to increase efficiency and longevity of an air conditioning unit while maintaining heated water in a conventional hot water tank using rejected air conditioning heat.

And yet still another object of this invention is to provide an improved energy conservation device readily adapted for connection to a conventional air conditioning unit and water heater storage tank which controls the operation of the water heating unit as a function of the operating status of the air conditioning unit.

In accordance with these and other objects which will be apparent hereinafter, the instant invention will now be described with particular reference to the accompanying drawings.

FIG. 1 shows a schematic diagram of one embodiment of the instant invention.

PREFERRED EMBODIMENT OF THE INVENTION

Referring now to the drawings, the instant invention is shown generally at 10 and comprised of a heat exchanger 12 which includes a closed chamber 14 which receives relatively cold water from storage tank 20 through circulating pump 18, the water being returned to the storage tank through conduit 34 after heating.

Disposed in return conduit 34 is a thermostatic switch 32 which is electrically coupled to circulating pump 18.

Compressor 28 represents a conventional compressor found in an air conditioning system and is connected to a conventional condenser 26 by a conduit 16 having segment 16a which is disposed within the heat exchanger 12. Conduit 16 receives the hot gasses from the compressor, and includes a pressure sensing switch 30 which is preset to open at a particular pre-determined pressure within conduit 16 and is electrically connected to the primary tank heater control 24. Control 24 represents the primary tank heater control which in a conventional heater would be the primary energy source for heating and maintaining a pre-determined temperature of water within the storage tank. In the instant invention, however, pressure switch 30 turns off the primary tank heater 22 whenever the pressure of compressor gas in the conduit 16 reaches a pre-determined value. This insures that there is no loss of energy by having the primary tank heater control conventionally actuated whenever there is available heat energy during the operation of the compressor.

The circulating pump 18 which has its input 36 connected to the lower portion of the storage tank, where the relatively colder water is maintained, will circulate water whenever the heated water downstream of the heat exchange 12 is sensed to be at or below a particular temperature set in the thermostatic switch 32. Whenever the output water temperature which is recirculated back into the storage tank 20 reaches a certain level, the thermostatic switch 32 will shut off the pump 18.

Hot refrigerant gas is routed through the inner conduit of the heat exchanger, with water being routed between the outside wall of the inner conduit and the inside wall of the outer chamber. Since heat flows from a higher temperature to a lower temperature, the water absorbs the heat. Because the water temperature is always lower than that of the hot gases, the heat loss to ambient air is minimal and insulation of the heat exchanger is not required.

The instant invention has been shown and described in what is considered to be the most practical and preferred embodiment. It is recognized, however, that departures may be made therefrom within the scope of the invention and that obvious modifications will occur to a person skilled in the art.

What I claim is:

1. An energy saving device for increasing the operational efficiency of an air conditioning system having a compressor utilizing a refrigerant while providing heat energy for a stored liquid comprising:

a liquid storage tank;

liquid primary heating means connected to said storage tank;

a control means connected to said liquid primary heating means;

a heat exchanger, said heat exchanger including an outer chamber having an inlet and an outlet and an inner chamber having an inlet and an outlet;

means for connecting the inlet and the outlet of said outer chamber to said liquid storage tank;

compressor conduit inlet means connected to said inner chamber outlet of said heat exchanger;

an outlet compressor refrigerant conduit means connected to said inner chamber inlet of said heat exchanger; a refrigerant pressure responsive switching means connected to said outlet compressor refrigerant conduit means and electrically connected to said primary heater control means, said pressure responsive switching means for shutting off the primary heater control whenever a predetermined pressure of refrigerant exists in said compressor unit; a circulating pump connected to said outer chamber inlet conduit and said storage tank; and thermostatic switch means connected in said outlet outer chamber return line and coupled to said outlet for controlling the actuation of said circulating pump as a function of liquid temperature in said return line.

2. A device as in claim 1, wherein:

the inlet conduit in said compressor line is disposed at the opposite end of said inlet outer conduit chamber from said storage tank whereby the flow of compressor gasses in the inlet side is opposite that of the flow of liquid through said outer chamber.

3. An energy saving device as in claim 2, wherein:

said outer heat exchange chamber includes a spiral baffling path disposed about said inner chamber to cause the liquid flow therethrough to be in a spiral path.

* * * * *